US005469804A

United States Patent [19]

Bracken

[11] Patent Number: 5,469,804

[45] Date of Patent: Nov. 28, 1995

[54] INSTRUMENT MOUNTING APPARATUS FOR SAILBOATS

[76] Inventor: William D. Bracken, 4 Canyon Ridge, Rockwall, Tex. 75087

[21] Appl. No.: 306,122

[22] Filed: Sep. 14, 1994

[51] Int. Cl.[6] ..... B63B 17/00

[52] U.S. Cl. ..... 114/343; 114/90

[58] Field of Search ..... 114/90, 102, 343; 248/218.4, 223.4, 231, 83

[56] References Cited

U.S. PATENT DOCUMENTS

| | | | |
|---|---|---|---|
| 2,362,901 | 11/1944 | Jamie | 248/231 |
| 3,345,028 | 10/1967 | Lawrie | 248/231 |
| 4,659,044 | 4/1987 | Armstrong | 248/218.4 |
| 5,154,386 | 10/1992 | Heck | 248/218.4 |

OTHER PUBLICATIONS

Layline Compass Mast Mounts (p. 36).

*Primary Examiner*—Sherman Basinger
*Attorney, Agent, or Firm*—Daniel Rubin

[57] ABSTRACT

Mounting apparatus for securing instruments onto the mast of a sailboat comprising a U-shaped frame adapted for lateral placement in an interfit relation with the mast and hose straps extending from one side of the frame to about the backside of the mast for receipt by hose clamps on the other side of the frame that draw the straps and frame into a snug-tight relation about the mast.

9 Claims, 1 Drawing Sheet

INSTRUMENT MOUNTING APPARATUS FOR SAILBOATS

FIELD OF THE INVENTION

The field of art to which the invention relates comprises sailboats and more particularly to mounting apparatus by which to secure boat instrumentation at a selected location on the mast supporting the sails and/or rigging.

BACKGROUND OF THE INVENTION

It is a common standard for sailboats that various instrumentation, such as a compass, knotmeter, etc. be provided to assist the crew in navigation of the boat. For optimal benefit, such instrumentation is typically placed at a convenient sighting location above the hull on or about the mast.

DESCRIPTION OF THE PRIOR ART

Typical instrument mounting apparatus utilized for sailboats have resorted to screws or bolts penetrating into and through the mast wall or clamping screws in the mast luff groove. Such installations render the installation substantially permanent while adversely affecting the integrity and appearance of the mast. As a result, the instrumentation cannot easily be removed for mast erection, not to mention the deleterious affect on the mast itself.

OBJECTS OF THE INVENTION

It is therefore an object of the invention to provide novel apparatus for mounting instrumentation on the mast of a sailboat.

It is a further object of the invention to effect the previous object with mounting apparatus that is readily removable yet will not adversely affect the integrity and/or appearance of the mast.

It is a still further object of the invention to effect the previous objects with a mounting apparatus that readily and automatically aligns the instrument panel face perpendicular to the keel or centerline of the hull.

SUMMARY OF THE INVENTION

This invention relates to improved mounting apparatus for securing instrumentation onto the mast of a sailboat. More particularly, the invention relates to such apparatus that can be readily mounted onto the mast without the use of screws and/or bolts being caused to penetrate the mast while being easily installed and conveniently removable with a minimum of effort.

The foregoing is achieved in accordance herewith by means of a mounting structure formed of an impact and corrosion resistant U-shaped frame with converging sides for embraced engagement at its open end against the mast on which it is to be installed. The front wall of the frame provides a panel face that can be readily cut through its face for receipt of an instrument to be mounted. Positioned behind the front wall so as to define an intervening instrument cavity is a bulkhead having an integral, rearwardly facing vertical key for interfitting with the existing luff groove of the mast. Progressively slotted straps secured on one side of the frame extend to a free distal end enabling the strap to be removably wrapped about the mast to the opposite side of the frame. A hose clamp secured on the opposite side of the frame receives the strap end and can be operative to draw or release the strap from a tightened wrap engagement about and against the mast. When installed, the mounting structure bears a lateral relation to the mast with the panel face in a perpendicular relation to the keel so as to lend clear visibility to the face of the instrument which it supports. Being that the installation does not require any screw penetration of the mast, mast integrity and appearance remains intact and unaffected by the mounting structure.

The above noted features and advantages of the invention as well as other superior aspects thereof will be further appreciated by those skilled in the art upon reading the detailed description that follows in conjunction with the drawings.

DESCRIPTION OF THE PREFERRED EMBODIMENT

Figure 1:
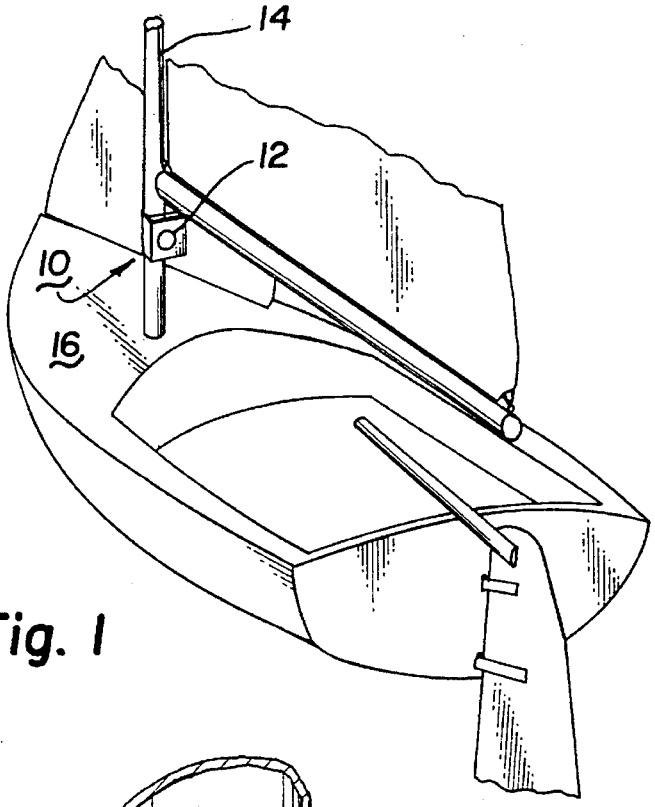
FIG. 1 is an isometric view of a sailboat on which the instrument mounting apparatus of the invention has been installed.
Figure 2:
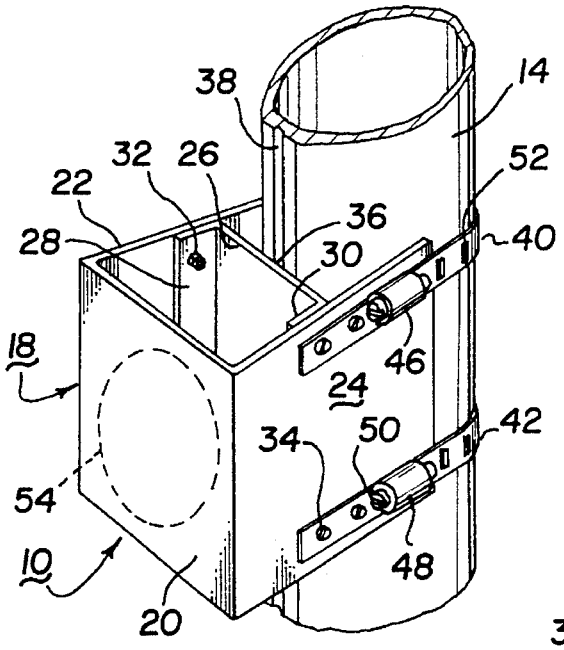
FIG. 2 is an enlarged isometric view of the mounting apparatus hereof in its installed relation.
Figure 3:
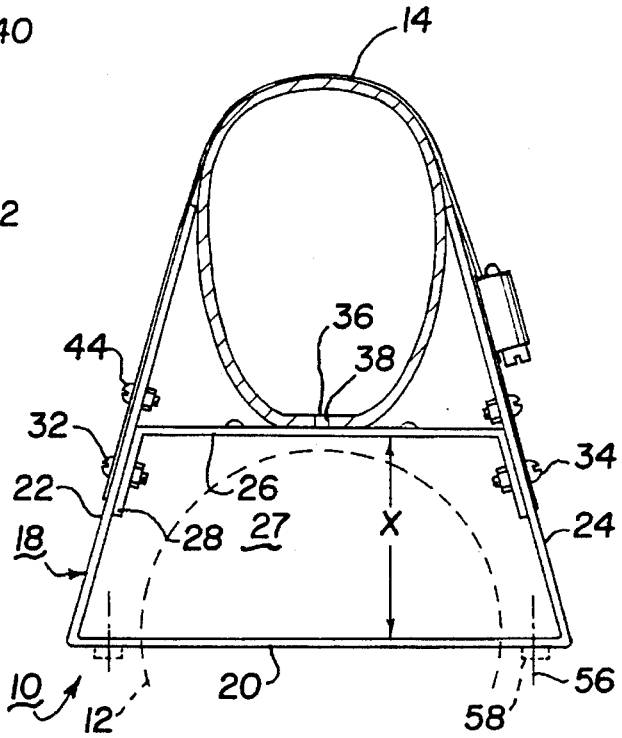
FIG. 3 is a top plan view of the installation of FIG. 2.

In the description which follows, like parts are marked throughout the specification and drawings with the same reference numerals respectively. The drawing figures are not necessarily to scale and in certain views, parts may have been exaggerated for purposes of clarity.

Referring now to the drawings, there is illustrated the mounting apparatus hereof designated 10 for supporting an instrument 12, such as a compass, knotmeter, etc. and removably mounted onto the mast 14 of a sailboat 16.

Comprising mounting apparatus 10 is a substantially U-shaped frame 18 defined by a front panel wall 20 and opposite converging side walls 22 and 24 spaced apart at their distal ends to receive and embrace mast 14. Transversely secured intervening between the side walls at a distance "X" behind the front wall is a parallel bulkhead 26 that with front wall 20 defines an intervening instrument cavity 27. The bulkhead includes side arms 28 and 30 by which to secure the bulkhead in place via screws 32 and 34 respectively. Integrally formed on the backside of bulkhead 26 is a vertical key 36 sized to interfit closely with the vertical luff groove 38 existing on mast 14.

For installing and securing the mounting apparatus hereof to mast 14, at least a pair of elongated, slotted and flexible stainless steel clamp straps 40 and 42 are secured vertically spaced apart unto side wall 22 via screws 44. From where connected, the straps can be caused to extend at their distal ends about the mast to stainless steel hose clamps 46 and 48 respectively secured on side 24. Each of the straps are of a length at least sufficient to wrap about the backside of the mast for their distal or lead end to be received and engaged by one of the hose clamps. As is well known, such hose clamps are commercially available and operable by an external screw 50 for its actuating mechanism to engage with the longitudinally successive slots 52 of the straps. The effect is to draw the straps thereto or retard the straps therefrom such that for purposes hereof it tightens or releases the straps and the mounting apparatus into or from engagement against the mast.

To accommodate and support an instrument 12 to be mounted by means of the apparatus hereof, an appropriate opening 54 is formed in front panel wall 20 after which the instrument can be inserted through the opening and into cavity 27. With the instrument face exposed, the instrument can then be secured to the surrounding surface of wall 20, as for example, by means of screws 56 extending through a bezel ring or flange 58. With key 36 interfitted in luff groove 38, it can be realized that the face of an instrument 12 is aligned to the rear of the mast perpendicular to the keel or center line of the hull. This enables mounting of a magnetic compass in a correct orientation with respect to the direction of the moving sailboat.

Frame 18 and bulkhead 26 are preferably formed of a composition sufficiently durable and corrosion resistant for the service and climatic conditions to which it will be exposed and serviced. A preferred material comprises polymeric plastic such as LEXAN® which has been found to exhibit the foregoing properties. Alternate sizes can be made available for appropriate masts.

For installing the mounting apparatus 10 with or without an instrument 12 in place, it is necessary only that straps 40 and 42 be free of their respective hose clamps before laterally advancing the unit toward the mast until inserting bulkhead key 36 into mast groove 38. Straps 40 and 42 can then be wrapped about the backside of the mast until engaging a respective hose clamp at which time the hose clamps are screwdriver operated by means of screw 50. The effect is to draw the strap and mounting apparatus against the mast and effect a tightened engagement therewith. Removal of the unit is equally simple and requires only that operation of the hose clamps be reversed until the respective straps detach from the hose clamps enabling the entire unit to be carried off at will. Being that placement of the unit onto the mast relies on a keyed interfit while installation depends merely on a strapping of the unit to the mast, the use of screws and/or bolts previously utilized for such purposes are omitted and totally unnecessary. Yet by these relatively novel combination of components, the installation and removal of instrument mounting for sailboats is substantially enhanced as compared to previous structures utilized for that purpose.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A mounting apparatus for mounting instruments onto the mast of a sailboat, said mounting apparatus comprising:

a substantially U-shaped frame adapted for lateral mounting onto said mast, said frame having a front wall and a pair of side walls extending from said front wall to distal ends defining an intervening gap therebetween in which to receive said mast;

placement means on said frame for effecting a placement interfit between said frame and a formation on said mast; said placement means comprising a recess defined in an exposed surface of one of said mast or said frame and a protuberance projecting outward from an exposed surface of the other of said mast or said frame for receipt inward of said recess;

a bulkhead secured transversely extending between said sidewalls at a predetermined distance behind said front wall so as cooperable with said front wall to define an intervening instrument cavity for receiving at least a rear portion of an instrument to be mounted through an opening in the front wall of said frame; and mounting means to secure said frame onto said mast.

2. A mounting apparatus in accordance with claim 1 in which said mast onto which the apparatus is to be mounted includes a first formation comprising one of said recess or said protuberance and said placement means comprises a formation of the other of said recess or said protuberance of complementary cross-section disposed on an interior surface defining said intervening gap.

3. A mounting apparatus in accordance with claim 2 in which said first formation comprises a luff groove in said mast and said complementary formation comprises a key disposed on said interior surface.

4. A mounting apparatus in accordance with claim 3 in which said key is disposed on said bulkhead and said interfit effects a predetermined face orientation of an instrument mounted in said front wall relative to the direction of the keel on the boat to which it is mounted.

5. A mounting apparatus in accordance with claim 1 in which said front wall includes an aperture through which an instrument to be mounted can be supported extending into said cavity.

6. A mounting apparatus in accordance with claim 1 in which said frame comprises an integral composition and said sidewalls are angled linearly toward each other in a converging relation.

7. A mounting apparatus in accordance with claim 6 in which the composition of said frame comprises a polymeric plastic.

8. A mounting apparatus in accordance with claim 1 in which said mounting means comprises at least one flexible strap of a length at least sufficient to extend between a first end secured to one side wall of said frame to about the received mast to a second end in the vicinity of the other of said side walls; and clamp means secured on the other of said sidewalls to receive said second strap end and operative to secure said strap when drawn tautly about the received mast.

9. A mounting apparatus in accordance with claim 8 in which said clamp means comprises a plurality of hose clamps and said at least one strap comprises a plurality of vertically spaced metal clamp straps apertured to cooperate with said hose clamps when operative to be drawn therethrough.

* * * * *